US005167486A

United States Patent [19]

Detanne

[11] Patent Number: 5,167,486

[45] Date of Patent: Dec. 1, 1992

[54] TURBO-MACHINE STAGE HAVING REDUCED SECONDARY LOSSES

[75] Inventor: François Detanne, Paris, France

[73] Assignee: GEC Alsthom SA, Paris, France

[21] Appl. No.: 699,126

[22] Filed: May 13, 1991

[30] Foreign Application Priority Data

May 14, 1990 [FR] France ..... 90 05991

[51] Int. Cl.[5] ..... F01D 5/18

[52] U.S. Cl. ..... 415/115; 415/116; 415/914

[58] Field of Search ..... 415/115, 116, 170.1, 415/173.1, 175, 176, 914; 416/90 R, 91, 97 R

[56] References Cited

U.S. PATENT DOCUMENTS

| | | | |
|---|---|---|---|
| 2,945,671 | 7/1960 | Petrie . | |
| 3,051,438 | 8/1962 | Roberts et al. . | |
| 3,904,307 | 9/1975 | Dennison | 415/116 |
| 4,335,995 | 6/1982 | Riollet et al. | 415/914 |
| 4,761,116 | 8/1988 | Braddy et al. | 415/115 |
| 4,830,575 | 5/1989 | Bandukwalla | 416/95 |

FOREIGN PATENT DOCUMENTS

| | | | |
|---|---|---|---|
| 1223623 | 8/1966 | Fed. Rep. of Germany | 415/116 |
| 1403089 | 11/1968 | Fed. Rep. of Germany | 415/116 |
| 1159970 | 6/1985 | Fed. Rep. of Germany | 415/116 |
| 1194770 | 4/1902 | France | 415/116 |
| 2439157 | 4/1980 | France . | |
| 60-14161 | 4/1985 | Japan . | |
| 1013835 | 12/1965 | United Kingdom . | |

OTHER PUBLICATIONS

Power, vol. 133, No. 6, Jun. 1989, New York, USA, pp. S4–S5, "Steam Turbines and Auxiliaries".

*Primary Examiner*—John T. Kwon

*Attorney, Agent, or Firm*—Sughrue, Mion, Zinn, Macpeak & Seas

[57] ABSTRACT

A turbine stage comprising a set of fixed vanes (1) fixed to the stator (3) of the turbine and supporting a diaphragm, followed by a set of moving vanes (8) mounted on a disk (9) which is fixed to the rotor (6) of the turbine, the periphery of the set of moving vanes (8) having seals (10) constituted by a plurality of chambers (11). The disk (9) includes suction orifices (16) opening out into the space between the diaphragm (4) and the disk (9) and disposed in the vicinity of the peripheral portion of the disk (9). The suction orifices (15) are connected by ducts (17) passing through at least some of the moving vanes (8) to outlet orifices (18) which open out in the tips of the vanes (8) downstream from the seals (10) within a chamber (11) thereof. The disturbed flow at the roots of the fixed vanes (2) and the leakage flow between the diaphragm (4) and the rotor (6) are sucked into the orifices (16), thereby improving efficiency.

5 Claims, 3 Drawing Sheets

TURBO-MACHINE STAGE HAVING REDUCED SECONDARY LOSSES

The present invention relates to a turbine stage comprising a set of fixed vanes fixed to the stator of the turbine and supporting a diaphragm, followed by a set of moving vanes mounted on a disk which is fixed to the rotor of the turbine, the periphery of said set of moving vanes having sealing means constituted by a plurality of chambers.

The disk including suction orifices opening out into the space between the diaphragm and the disk and disposed in the vicinity of the peripheral portion of the disk.

Such a stage is described in Japanese publication JP-B 14161/85.

In the stage described, the suction orifices are connected via channels drilled through the disk to outlet orifices that open out at the top of the disk carrying the moving vanes, downstream from the vanes.

In this stage, it is desired to reduce secondary losses in the fluid flow along the moving channels in the root region of the blade. This is done firstly by sucking up a portion of the leakage flow passing between the diaphragm and the rotor in order to prevent it disturbing the fluid stream at the roots of the moving vanes, and secondly by sucking up a portion of this fluid stream coming from the stationary vane, level with the roots of the moving vane, which flow is also disturbed, thereby preventing it entering into the moving channels for low energy fluid layers.

However, in the stage described, the suction is not perfect. According to the invention, the stage enabling suction to be improved is characterized in that said suction orifices are connected by ducts passing through at least some of the moving vanes to outlet orifices which open out in the tips of the vanes downstream from the sealing means or into a chamber thereof.

In the stage of the invention, the pressure difference between the suction orifices and the outlet orifices results from the effect of centrifugal force which is always present, whereas the pressure difference between the upstream face and the downstream face may disappear in an impulse turbine which would make the stage described in JP-B 14161/85 inoperative.

The suction orifices are preferably interconnected by a continuous circumferential groove formed in the disk supporting the moving vane.

The present invention will be better understood in the light of the following description in which.

Figure 1:
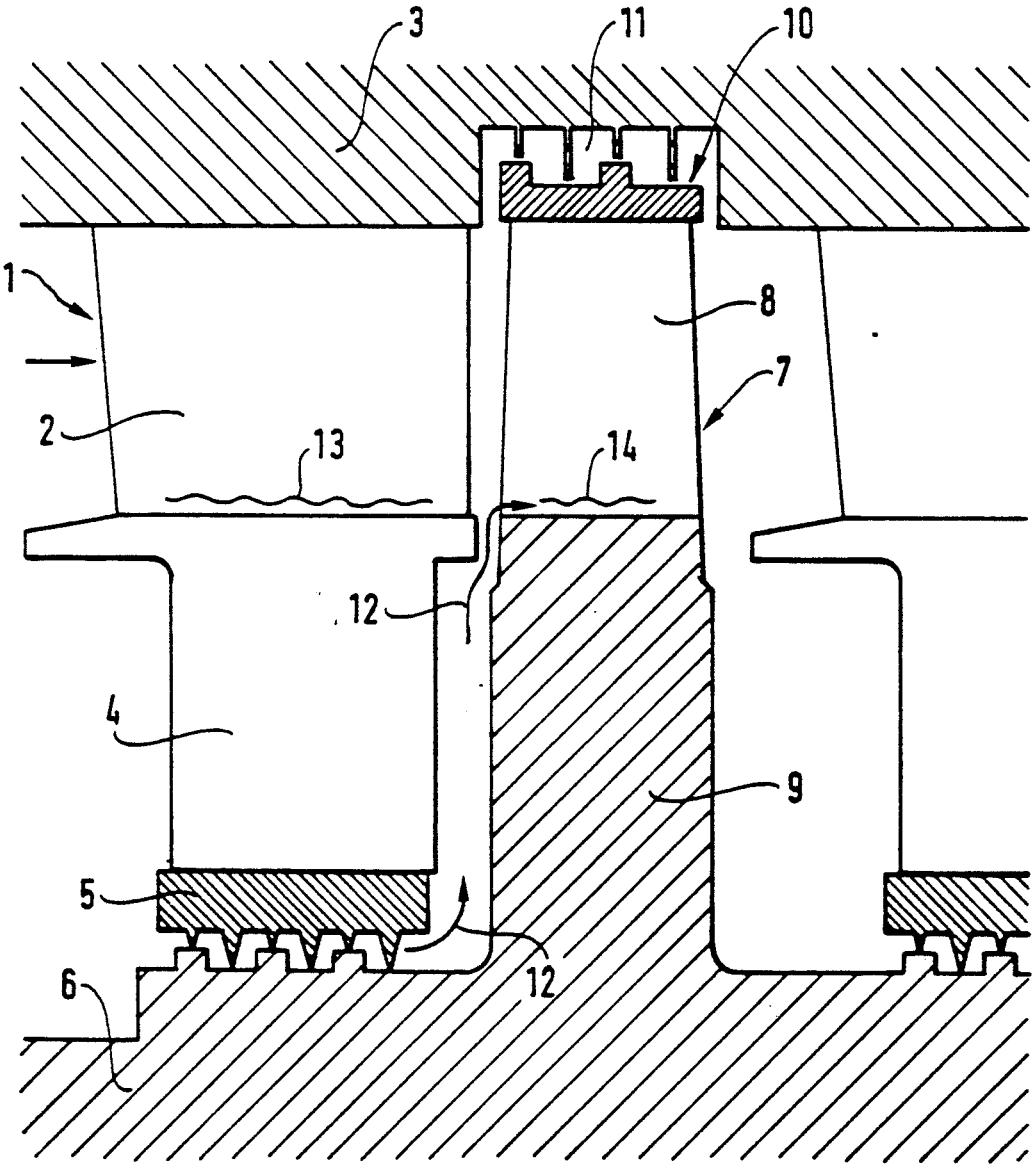
FIG.1 PRIOR ART
FIG. 1 shows an ordinary turbine stage.

An ordinary impulse turbine stage (FIG. 1) comprises a set 1 of fixed vanes 2 that are fixed to the stator 3. The set 1 supports a diaphragm 4 provided with sealing means 5 facing the rotor 6 of the turbine.

The set 1 is followed by a set 7 of moving vanes 8 carried by a disk 9 which is fixed to the rotor 6. Sealing devices 10 including a plurality of chambers 11 are disposed at the tips of the moving vanes 8.

A leakage flow 12 coming from the upstream side of the diaphragm 4 passes through the sealing means 5 and is injected to the roots of the moving vanes 8. This flow 12 disturbs the main flow and therefore reduces efficiency. This reduction is very significant for vanes 8 that are stubby (a small ratio of height divided by chord). In addition, a secondary flow 13 develops at the roots of the vanes 1.

The effects of the flows 12 and 13 is to develop a secondary flow 14 at the roots of the moving vanes 8 which gives rise to a work deficit on the shaft. The thicker the incident flows 12 and 13, the thicker the flow 14.

Figure 3:
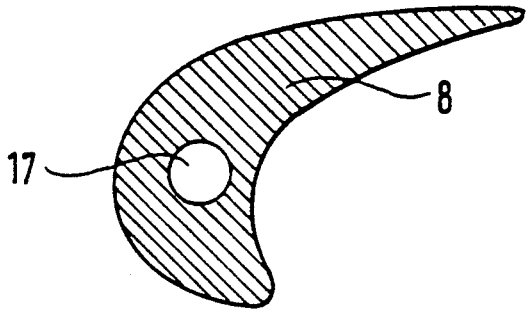
FIG. 3 is a fragmentary axial view of the FIG. 2 stage.
Figure 4:
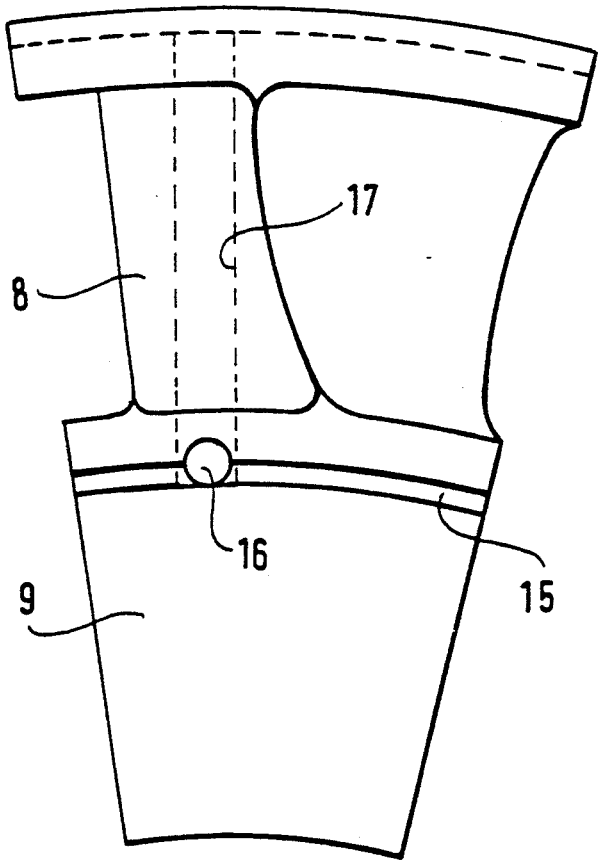
FIG. 4 is a cylindrical section through FIG. 3.

In the turbine stage of the invention (FIGS. 2 to 4) items that are identical with the ordinary stage have been given identical references.

In the vicinity of the peripheral portion of the disk 9 facing the diaphragm 4 of the preceding fixed set of vanes 1, the disk 9 is provided with a circumferential groove 15 into which suction or inlet orifices 16 open out at least over a portion of their diameters.

These orifices are connected by radial ducts 17 passing through the moving vane 8 to outlet orifices 18 that open out downstream from the sealing means 10.

A major portion of the flows 12 and 13 is sucked into the orifices 16, thereby reducing disturbances to the stream at the roots of the vanes 8, thus providing a significant increase in efficiency.

The pressure difference between the inlet orifice 16 and the outlet orifice 18 suitable for putting the fluid into motion is generated by centrifugal force: $\frac{1}{2}w^2(R_2^2-R_1^2)$, in which:

w is the angular velocity of the disk 9;

$R_2$ is the distance of the outlet orifices 18 from the axis of the rotor 6; and $R_1$ is the distance from the inlet orifices 16 to the axis.

Up to one duct 17 per moving vane 8 may be provided.

The continuous circumferential groove 15 interconnecting the portions of the orifices 16 that are closest to the axis of the rotor serves to make the various tangential speeds of the flows 12 and 13 more uniform.

The pumping achieved by the work done by centrifugal force between radii $R_1$ and $R_2$ naturally gives rise to drag, however the overall effect is positive because of the significant reduction of secondary losses and because of the resulting improved flow, particularly in low-level streams. This pumping is particularly useful in impulse turbines where the pressures on opposite sides of the disk are equal.

Figure 2:
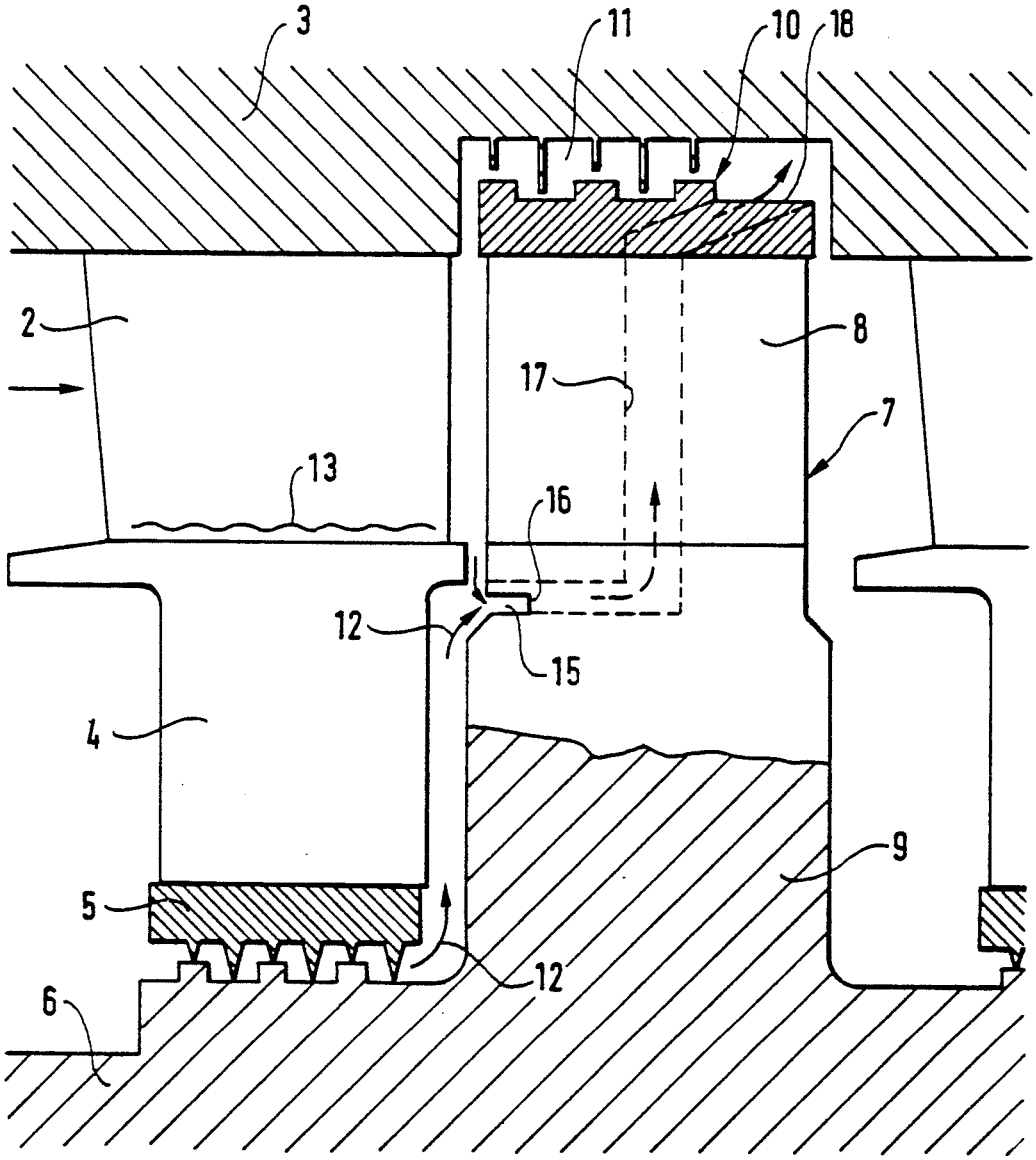
FIG. 2 shows a turbine stage of the invention.

FIG. 2 shows the orifice 18 opening out downstream from the sealing device 10, however it could open out into one of the chambers 11 of the device 10.

I claim:

1. A turbine stage comprising a set of fixed vanes (1) fixed to a stator (3) of a turbine and supporting a diaphragm, followed by a set (7) of moving vanes (8) mounted on a disk (9) which is fixed to a rotor (6) of said turbine, the periphery of said set (7) of moving vanes (8) having sealing means (10) constituted by a plurality of chambers (11), said disk (9) including suction orifices (16) opening out into the space between the diaphragm (4) and the disk (9) and disposed in the vicinity of the peripheral portion of the disk (9), said suction orifices (15) being connected by radial ducts (17) passing through at least some of the moving vanes (8) and terminating in outlet orifices (18) opening out in the peripheral tips of the moving vanes (8), whereby the leakage flow between the diaphragm and the rotor and secondary flow across the roots of fixed blades (2) passes through the suction orifices (16) and the radial ducts to said outlet orifices 18 such that the pressure difference between the suction orifices and the outlet orifices results from the effect of centrifugal force to eliminate adverse secondary flow effects over the moving vanes (8) in the root region of the moving vanes (8).

2. A turbine stage according to claim 1, characterized in that the suction orifices (16) are interconnected by a continuous circumferential groove (15) formed in the disk (9).

3. A turbine stage according to claim 1, characterized in that the turbine is an impulse turbine.

4. A turbine stage according to claim 1, wherein said outlet orifices (18) open out in the peripheral tips of the moving vanes (8) downstream of the chambers of said sealing means.

5. A turbine stage according to claim 1, wherein said outlet orifices (18) open out in the peripheral tips of the moving vanes (8) within one of said chambers (11).

* * * * *